US010940482B2

(12) United States Patent
Dulmes

(10) Patent No.: US 10,940,482 B2
(45) Date of Patent: Mar. 9, 2021

(54) CLEARING CYLINDER AND ASSEMBLY FOR USE WITH A ROCK CRUSHER

(71) Applicant: Jerrod Dulmes, New Berlin, WI (US)

(72) Inventor: Jerrod Dulmes, New Berlin, WI (US)

(73) Assignee: Optimum Crush, Inc., New Berlin, WI (US)

( * ) Notice: Subject to any disclaimer, the term of this patent is extended or adjusted under 35 U.S.C. 154(b) by 327 days.

(21) Appl. No.: 15/419,603

(22) Filed: Jan. 30, 2017

(65) Prior Publication Data

US 2017/0216847 A1 Aug. 3, 2017

Related U.S. Application Data

(60) Provisional application No. 62/289,514, filed on Feb. 1, 2016.

(51) Int. Cl.
*B02C 2/04* (2006.01)

(52) U.S. Cl.
CPC ..... *B02C 2/04* (2013.01); *B02C 2/045* (2013.01)

(58) Field of Classification Search
CPC ..... B02C 2/00; B02C 2/04; B02C 2/045
USPC ..... 241/207–209, 211–215
See application file for complete search history.

(56) References Cited

U.S. PATENT DOCUMENTS 3,315,901 A * 4/1967 Pollitz ..... B02C 2/04 241/211
3,837,585 A * 9/1974 Decker ..... B02C 2/04 241/213
3,887,143 A * 6/1975 Gilbert ..... B02C 2/04 241/215
3,985,308 A * 10/1976 Davis ..... B02C 2/045 241/290
4,750,681 A * 6/1988 Sawant ..... B02C 2/04 241/208
8,308,095 B2 * 11/2012 Solomon ..... B02C 2/045 241/207
9,309,974 B1 * 4/2016 Woodcock ..... F16J 15/3236
2004/0035967 A1 * 2/2004 Johnson ..... B02C 2/04 241/207

(Continued)

OTHER PUBLICATIONS

Parker O-Ring Handbook, 2007, Parker Hannifin Corporation, 50th Anniversary Edition, p. 1-6 and 5-3 (Year: 2007).*

(Continued)

*Primary Examiner* — Shelley M Self
*Assistant Examiner* — Katie L. Parr
(74) *Attorney, Agent, or Firm* — Davis & Kuelthau, S.C.; Erin E. Kaprelian; Joseph S. Heino

(57) ABSTRACT

A clearing cylinder comprises an upper cylindrical housing, a lower cylindrical housing, and a head assembly. The upper cylindrical housing further comprises an upper surface having a first circumferential recess, a first wiper ring disposed within the first circumferential recess, an upper side wall, and an upper bore defined within the upper side wall. The lower cylindrical housing further comprises a lower side wall defining an internal cylindrical cavity and containing a breather vent. The head assembly is disposed between the upper cylindrical housing and the lower cylindrical housing and further comprises a second circumferential recess defined within a topmost inside surface of the head assembly and a second wiper ring disposed within the second circumferential recess.

6 Claims, 6 Drawing Sheets

(56) References Cited

U.S. PATENT DOCUMENTS

| | | | | |
|---|---|---|---|---|
| 2004/0062628 | A1* | 4/2004 | Alexander | B65G 69/003 414/401 |
| 2012/0006918 | A1* | 1/2012 | Belotserkovskiy | B02C 2/04 241/25 |
| 2012/0187224 | A1* | 7/2012 | Repinski | B02C 2/04 241/15 |
| 2015/0292220 | A1* | 10/2015 | Weijers | F15B 15/14 4/495 |
| 2015/0360228 | A1* | 12/2015 | McCloskey | B02C 2/045 241/32 |
| 2017/0333909 | A1* | 11/2017 | Kuvaja | B02C 2/047 |
| 2018/0243745 | A1* | 8/2018 | Niklewski | B02C 2/04 |

OTHER PUBLICATIONS

George Totten, 2012, Handbook of Hydraulic Fluid Technology. Boca Raton: CRC Press, https://doi.org/10.1201/b11225, p. 48 and 747. (Year: 2012).*

* cited by examiner

CLEARING CYLINDER AND ASSEMBLY FOR USE WITH A ROCK CRUSHER

FIELD OF THE DISCLOSURE

This disclosure relates generally to machines of the type that are often referred to as rock "crushers," which are constructed to apply mechanical force to rocks so as to break rocks into smaller rocks. Rock crushing machines typically place rocks between two solid surfaces and then apply sufficient pressure to draw the surfaces together, thereby fracturing rocks captured between the surfaces into a size that is desired or required. More specifically, this disclosure relates to an improved clearing cylinder used within such rock crushing machines.

BACKGROUND OF THE DISCLOSURE

Rock crushing machines (also referred to herein as simply "crushers") break rocks into smaller pieces by squeezing the rocks between two surfaces. One type of crusher is a cone crusher that comprises an eccentrically gyrating and wear resistant mantle and a bowl liner. During use, rocks are fed into the top, or hopper assembly, of the crusher. As gravity draws the rocks downwardly, they become wedged and then squeezed in a crushing chamber between the mantle and the bowl liner until they are broken. As the rocks are broken into smaller pieces, these smaller pieces drop down into the crusher, their size being further reduced by further squeezing and fracturing, which continues until the rock pieces are small enough to fall through an opening at the bottom of the crusher.

When a crusher gets overloaded, it can jam, seize or stall. This can result in material being left in the crushing chamber. The crushing chamber must then be cleared of material. Most cone crushers comprise spring or hydraulic release systems that serve to provide overload protection and minimize damage to the crusher when the crushing chamber is overloaded. To that end, hydraulic clearing cylinders can be incorporated into an assembly for clearing the crushing chamber.

One problem with clearing cylinders of current manufacture is that they frequently seize when water, dirt and dust (collectively, "debris") enter the rod area. That is, when the clearing cylinder piston retracts, it can pull debris into the cylinder, which is inherent in view of the environment that crushers are used within. This reduces the life of the clearing cylinder as well as all of the seals used in it. The only current solution to repairing such a clearing cylinder once debris has entered the cylinder is the remove it from the main frame and replace it. Alternatively, the cylinder body of the clearing cylinder can be unthreaded and disassembled in place, which is both difficult and time consuming.

In the view of this inventor, there is a need for an improved clearing cylinder and assembly that provides the necessary functionality described above, but avoids the problems encountered in clearing cylinders of the prior art.

SUMMARY OF THE DISCLOSURE

The improved clearing cylinder and assembly of the present disclosure provides a cylinder with enhanced capabilities. More specifically, the improved clearing cylinder of the present disclosure has a rod wiper located at the top of the cylinder to prevent debris from entering the cylinder, thereby extending the life of the improved clearing cylinder and the seals within it. The improved clearing cylinder also utilizes an additional wiper ring and an added breather in the cylinder body, which allows the cylinder to add or displace air without creating a vacuum that pulls debris in. The body of the improved clearing cylinder is also designed to help reduce maintenance time by having a bolted flange at the head assembly for quick and easy disassembly to access internal seals and avoiding the need to unthread any major parts.

The foregoing and other features of the present disclosure will be apparent from the detailed description that follows.

DETAILED DESCRIPTION

Figure 1:
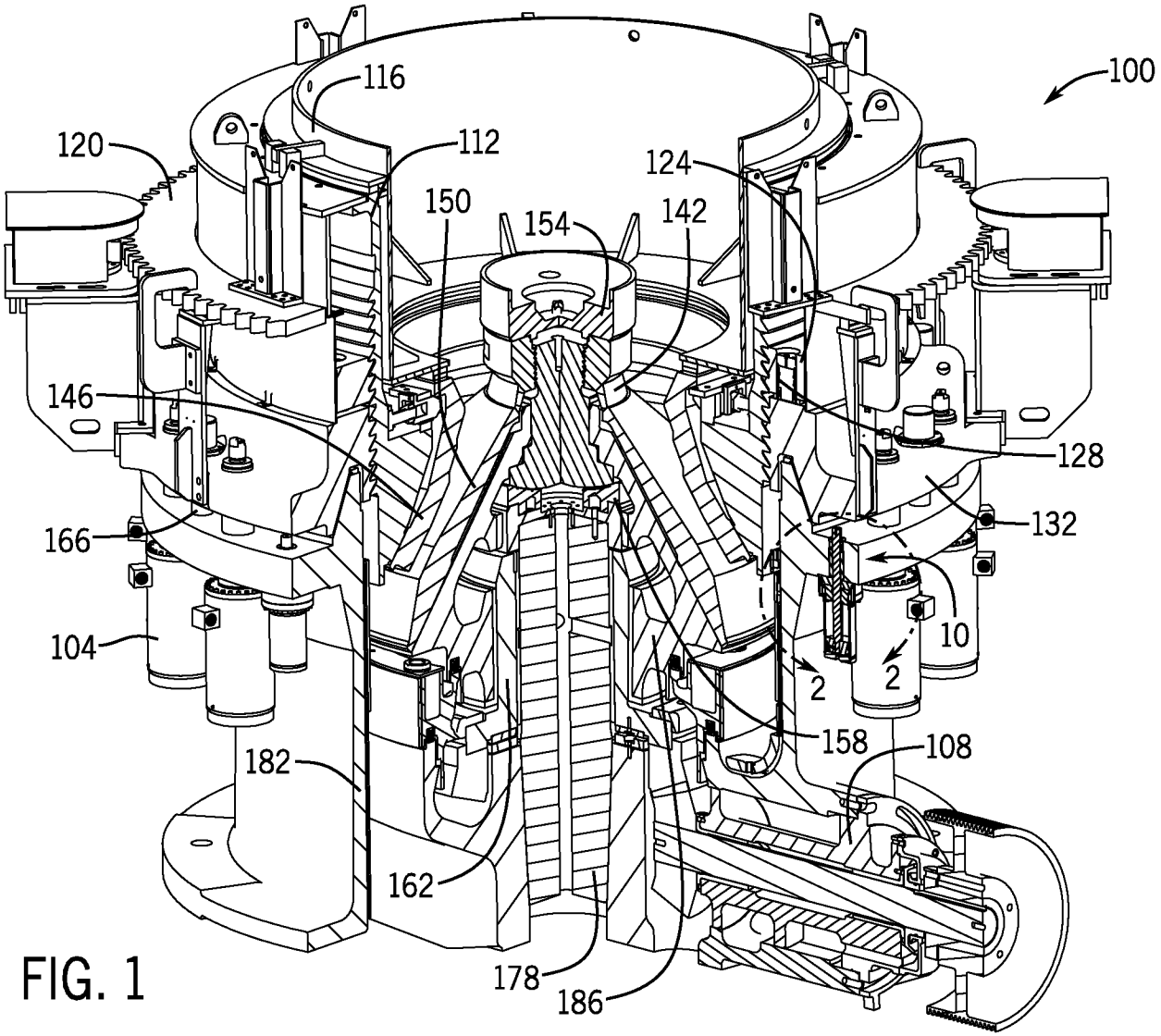
FIG. 1 is a side perspective view, partially broken away, of a cone rock crusher constructed in accordance with the present disclosure.
Figure 2:
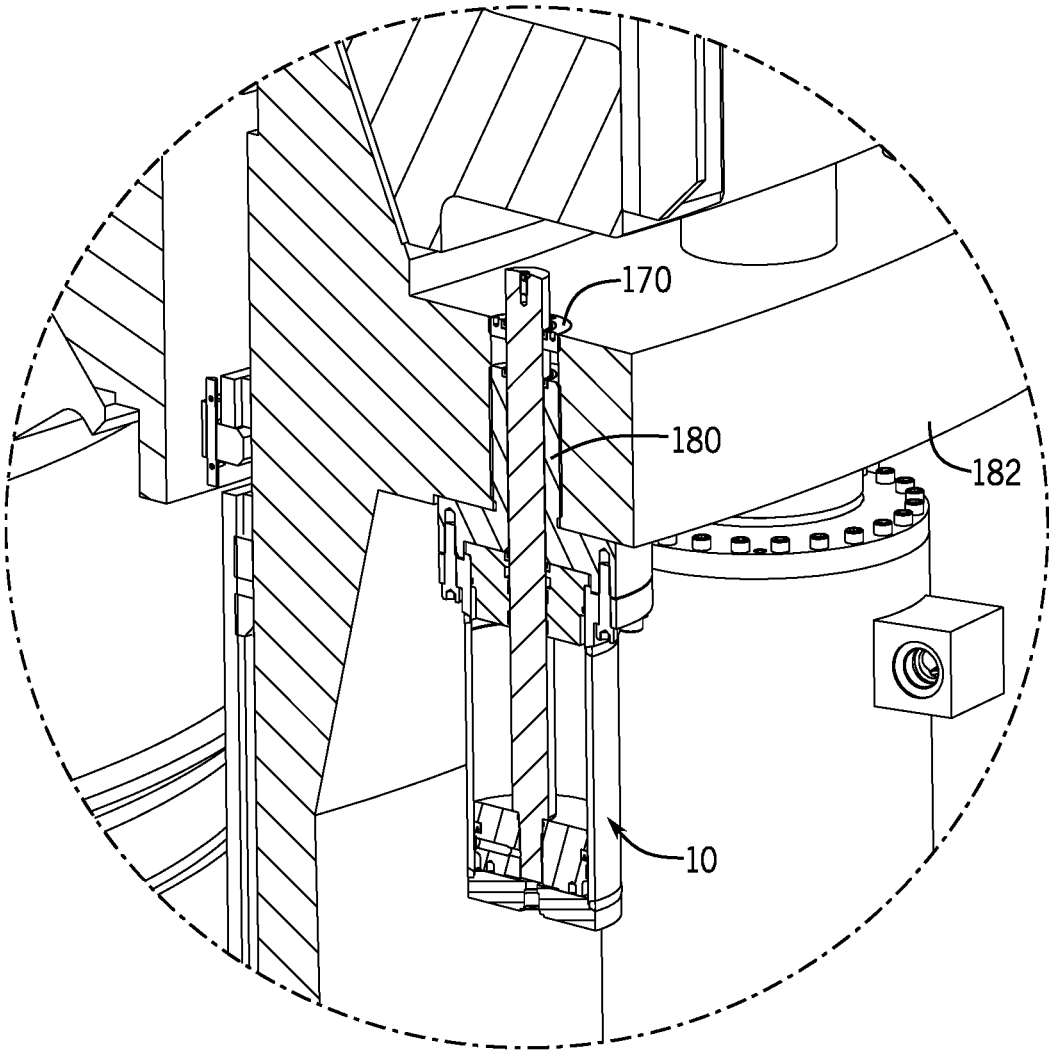
FIG. 2 is an enlarged cross sectional view illustrating the attachment of an improved clearing cylinder within the cone rock crusher shown in FIG. 1.

Referring now to the drawings in detail where like numbers represent like elements throughout, FIG. 1 illustrates a cone rock crusher 100. The cone rock crusher 100 comprises a main frame 182, a mantle 150 supported by a crusher head assembly 186 supported by the main frame 182, an adjustment ring assembly including an adjustment ring 132, the adjustment ring assembly being supported on but movable relative to the main frame 182. The cone rock crusher 100 also includes a bowl liner 146 attached to a bowl 112 threaded into the adjustment ring assembly, adjacent to but spaced apart from the mantle 150, and a hopper 116 supported above the adjustment ring assembly and opening into a space, the crushing chamber, between the bowl liner 146 and the mantle 150.

The cone rock crusher also includes a tramp release cylinder 104, a countershaft box assembly 108, and a bowl assembly including the bowl 112 and the hopper 116. The crusher 100 also includes an adjustment mechanism assembly 120, and the adjustment ring assembly including a clamping ring 124, a clamping cylinder 128, and the adjustment ring 132. The crusher 100 also includes a liner assembly including a wedge assembly, a torch ring 142, the bowl liner 146, and the mantle 150. The crusher 100 also includes a feed plate assembly 154, an eccentric assembly 162, a socket assembly 158, and the crusher head assembly 186. The crusher 100 also includes a main frame assembly including main frame pins 166, a clearing cylinder 10, a main shaft 178, and the main frame 182.

Figure 3:
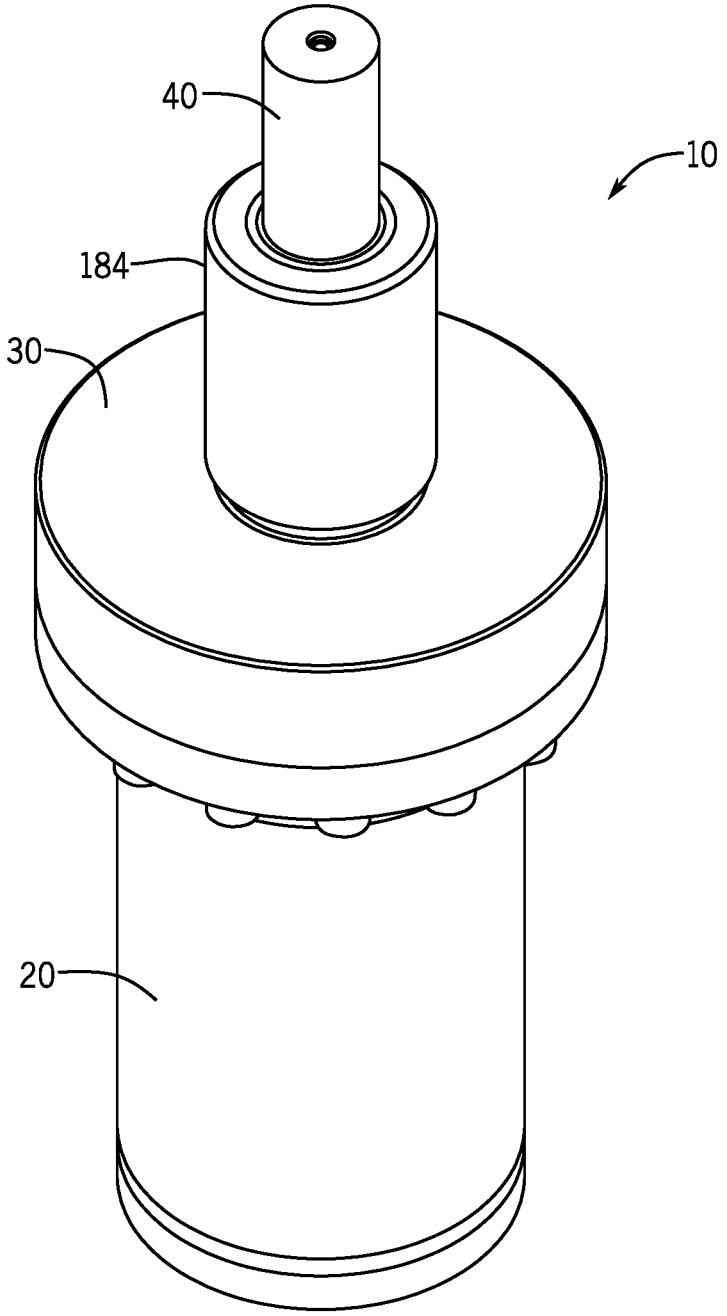
FIG. 3 is a top and front perspective view of the improved clearing cylinder that is constructed in accordance with the present disclosure.

FIG. 3 illustrates the improved clearing cylinder, generally identified 10, that is constructed in accordance with the present disclosure. As shown, the improved clearing cylinder 10 comprises a lower cylinder housing 20, and an upper cylinder housing 30 releasably connected to the lower cylindrical housing 20, and a rod 40 attached to a piston assembly 50.

The clearing cylinder 10 is attached to the main frame and is operable to extend the rod 40 to engage the adjustment ring assembly and to separate the adjustment ring assembly from the main frame 182. The rod 40 and piston assembly 50 are received in and movable relative to the lower cylindrical housing 20, and a portion of the rod 40 extends from one end of the upper cylindrical housing 30.

The clearing cylinder 10 also includes a first outwardly extending cylindrical flange 28 attached to one end of the lower cylindrical housing 20, a second outwardly extending cylindrical flange 38 attached to an opposite end of the upper cylindrical housing 30, and a head assembly 60 captured between the lower cylindrical housing 20 and the upper cylindrical housing 30. In other embodiments (not shown), the flanges can be omitted, and one of the upper cylindrical housing 30 and the lower cylindrical housing 20 can be threaded into the other of the upper cylindrical housing 30 and the lower cylindrical housing 20.

Figure 4:
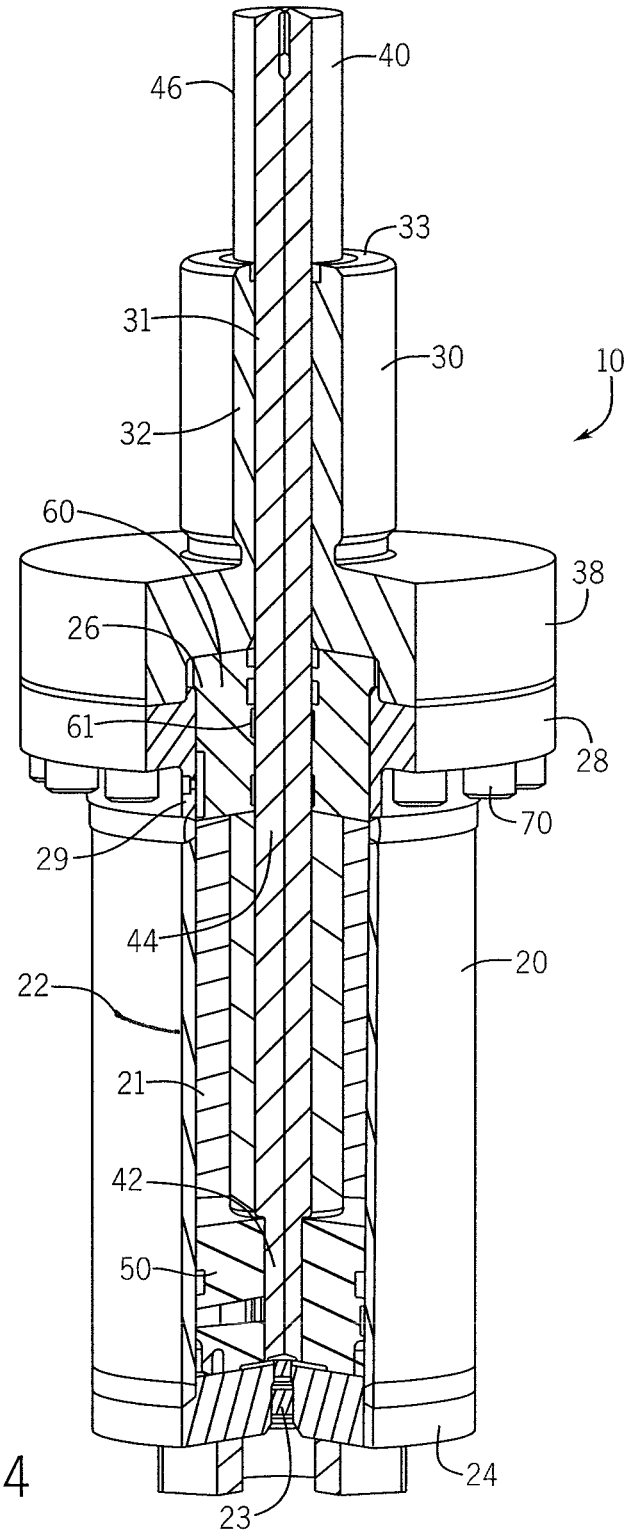
FIG. 4 is a front and partially sectioned view of the improved clearing cylinder shown in FIG. 1.

Referring now to FIG. 4, it shows that the lower housing 20 of the improved clearing cylinder 10 is configured somewhat in the form of a conventional hydraulic cylinder barrel. That is, the lower housing 20 comprises a sidewall 22 that is bounded by a closed bottom portion 24 and an open top portion 26. The sidewall 22 defines an internal cylindrical cavity or bore 21. The bore 21 of the lower housing 20 is provided to allow a piston assembly 50 and the bottommost portion 42 of a rod 40 that is attached to the piston assembly 50 to move upwardly and downwardly within the bore 21 of the lower housing 20. More specifically, movement of the piston assembly 50 within the cylinder 10 is accomplished via highly pressurized hydraulic fluid (not shown) flowing into and out of an opening 23 that is defined within the bottom portion 24 of the lower housing 20. In short, hydraulic fluid pressure exerted on the piston assembly 50 forces the piston assembly 50 and rod 40 upwardly within the cylinder 10. Unlike more conventional hydraulic cylinder configurations, however, the top portion 26 of the lower housing 20 comprises the outwardly extending circular flange 28. The flange 28 has a plurality of openings (also not shown) for passing or receiving fasteners 70 through the flange 28.

Disposed atop the uppermost portion of the lower housing 20 is the upper housing 30. The upper housing 30 likewise comprises an upper housing sidewall 32 and a bore 31 that allows an upper portion 46 of the rod 40 to move upwardly and downwardly within the upper housing bore 31. The bottommost portion of the upper housing 30 comprises the outwardly extending circular flange 38. The circular flange 38 is configured to "mate" with the flange 28 of the lower housing 20. The circular flange 38 of the upper housing 30 further comprises a plurality of threaded holes (not shown) for receiving a portion of the above-mentioned like-threaded fasteners 70 in them. Fasteners, preferably in the form of threaded bolts, coupled with the flanges 28, 38, advantageously help reduce maintenance time. That is, having such a bolted flange arrangement allows for quick and easy disassembly for accessing internal seals, for example, and avoids the need to unthread any major parts of the clearing cylinder 10, as is required by clearing cylinders of current conventional manufacture.

In the preferred embodiment of the present disclosure, using fasteners 70 for the securement of the flanges 28, 38 of the lower and upper housings 20, 30, respectively, allows for the "capture" of the head assembly 60 between the flanges 28, 38. The head assembly 60 has therein an inner surface defining a cylindrical bore 61 that is configured to receive a medial portion 44 of the rod 40, the rod 40 being movable upwardly and downwardly within the captured head assembly 60 via this bore 61. The bore 61 of the head assembly 60 further comprises a plurality of seals within it. As configured, it is to be understood that, unlike the piston assembly 50, the head assembly 60 of the clearing cylinder 10 is intended to be stationary relative to the other structures of the clearing cylinder 10. That is, the only moving parts of the clearing cylinder 10 are the piston assembly 50 and the rod 40, the rod 40 being attached to the piston assembly 50.

Figure 5:
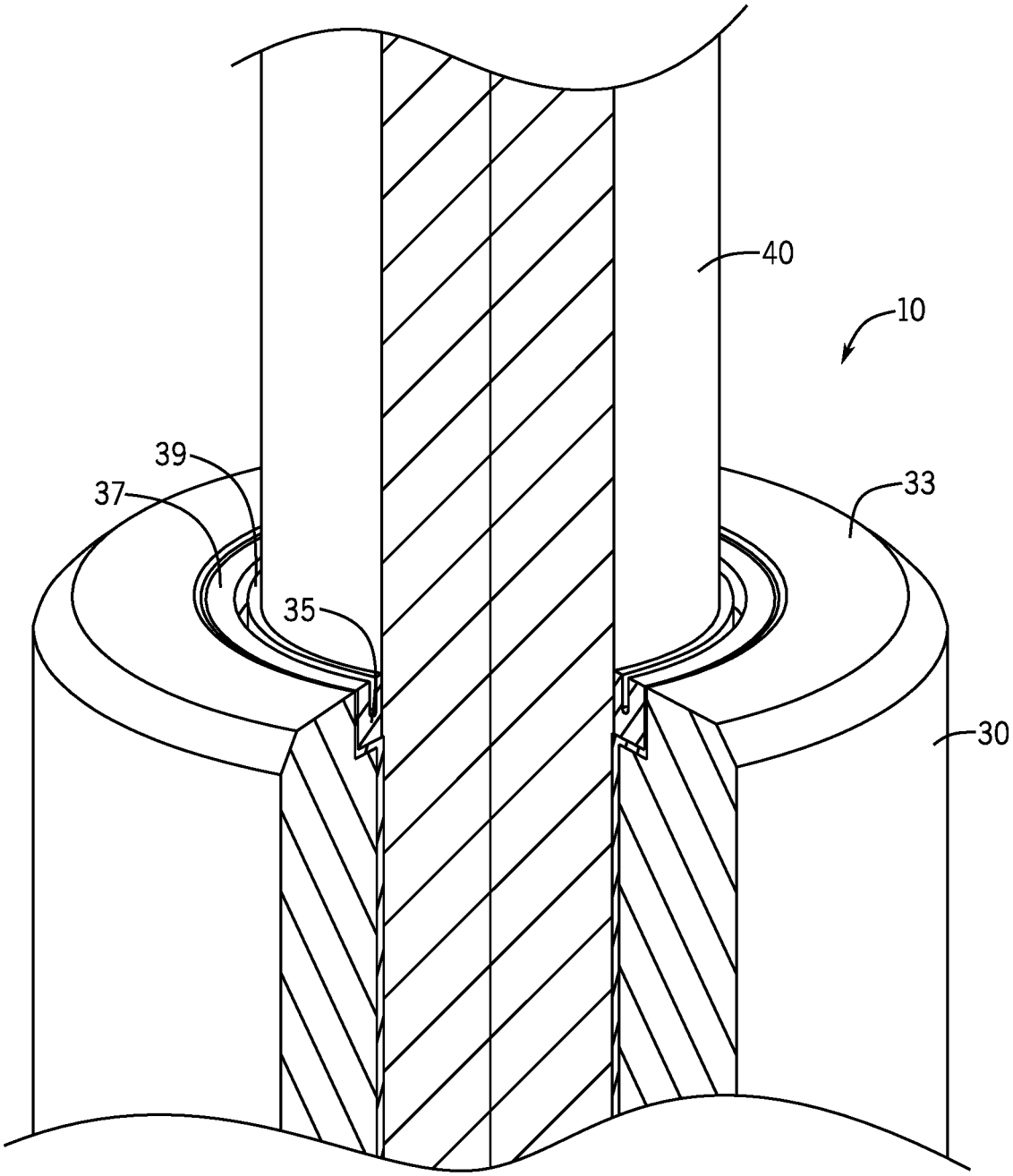
FIG. 5 is an enlarged portion of the view shown in FIG. 4 and illustrating the added rod wiper of the improved clearing cylinder.

Referring again to the upper housing 30 in greater detail, it is to be noted that the topmost upper surface 33 of the upper housing 30 comprises a circumferential recess 35 defined in it. See FIG. 5. Housed within this circumferential recess 35 is a somewhat U-shaped circumferential wiper ring 37 having an innermost portion 39. This circumferential wiper ring 37 encircles the upper portion 46 of the rod 40. In this configuration, the innermost portion 39 of the wiper ring 37 is provided to prevent debris from entering the clearing cylinder 10, thereby extending the life of the clearing cylinder 10 and all of its seals, including the seals defined within the head assembly 50.

Figure 6:
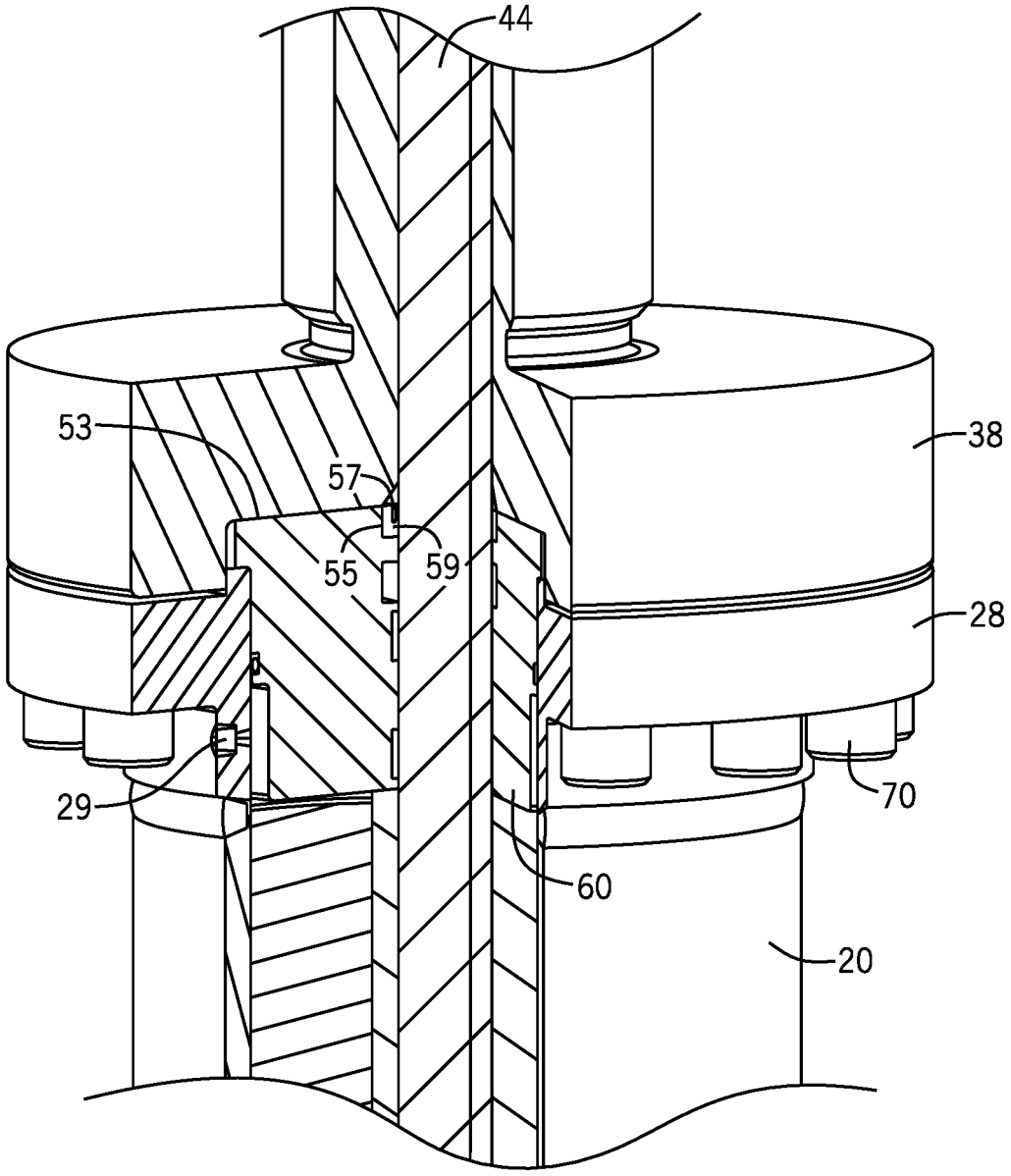
FIG. 6 is a further enlarged portion of the view shown in FIG. 4 and illustrating the added head assembly wiper and breather vent of the improved clearing cylinder.

Referring again to the head assembly 50 in greater detail, it is to be noted that the topmost inside surface 53 of the head assembly 50 has a circumferential recess 55. See FIG. 6. Housed within this circumferential recess 55 is a somewhat U-shaped circumferential wiper ring 57 having an innermost portion 59. This circumferential wiper ring 57 encircles the medial portion 44 of the rod 40. In this configuration, the innermost portion 59 of the wiper ring 57 is provided to likewise prevent debris from entering the clearing cylinder 10. This serves to extend the life of the clearing cylinder 10 and all of its seals, such seals being defined within the head assembly 50 and are positioned immediately adjacent the outer surface of the rod 40.

Referring again to FIGS. 4 and 6, it will be appreciated that the sidewall 22 of the lower housing 20 further comprises an adder breather vent 29. This added breather vent 29 in the clearing cylinder 10 allows the cylinder 10 to add or displace air without creating a vacuum that "pulls" debris or contaminants into the cylinder 10 from above. When the clearing cylinder 10 is secured in the main frame 182, the breather vent 29 is below the clearing cylinder's supporting structure and has access to ambient air.

Lastly, and to the extent that the improved clearing cylinder 10 can be used within a rock crusher of conventional manufacture, this combination comprises an improved rock crushing assembly. In this regard, it is to be noted that the exterior surface of the upper cylindrical housing 30 has external threads (not shown) that screw into a like-threaded hole (not shown) of the main frame 182, which is how it is held in position. That is, the uppermost portion 46 of the rod 40 is the structure that will push against the bottom side of an adjustment ring 132 to lift the upper half of the crusher to clear it.

More particularly, a portion of the outer surface 184 of the upper cylindrical housing 30 is threaded and is received within a like threaded opening 180 in the main frame 182. Received within the threaded opening 180, spaced apart from the upper end of the upper cylindrical housing 30, is a rod wiper ring 170 that surrounds the rod 40. The rod wiper ring 170 prevents air and debris from entering the threaded opening.

In view of the foregoing, it will be apparent that there has been provided a new, useful and non-obvious clearing cylinder and assembly that improves the functionality of a clearing cylinder used with a rock crusher, the primary novelty of which is the incorporation of additional wiper 37, 57 and a breather vent 29. The secondary novelty of the cylinder 10 and assembly of the present disclosure is the coupling flanges 28, 38, the structure and use of which is described above.

The invention claimed is:

1. A cone rock crusher, comprising:

a main frame, wherein the main frame has a threaded opening;

a mantle, wherein the mantle is supported by the main frame;

an adjustment ring, wherein:

the adjustment ring is supported by the main frame;

the adjustment ring is movable with respect to the main frame; and the adjustment ring engages a rod, wherein the rod separates the adjustment ring from the main frame;

a bowl liner coupled to the adjustment ring;

a hopper coupled to the adjustment ring; and a clearing cylinder, wherein the clearing cylinder further comprises:

an upper cylindrical housing, the upper cylindrical housing further comprising:

a threaded outer portion to mate with the threaded opening of the main frame;

an upper surface, wherein the upper surface has a first circumferential recess disposed on a topmost inside surface of the upper surface;

a first wiper ring disposed within the first circumferential recess;

an upper side wall; and an upper bore defined within the upper side wall;

a rod wiper ring received within the threaded opening and spaced apart from the upper end of the upper cylindrical housing, wherein the rod wiper ring surrounds the rod;

a lower cylindrical housing, the lower cylindrical housing further comprising:

a lower side wall, wherein the lower side wall defines an internal cylindrical cavity;

a breather vent disposed within the lower side wall, wherein the breather vent has access to ambient air;

a closed bottom portion disposed at a first boundary of the lower side wall;

an opening defined within the closed bottom portion; and an open top portion disposed at a second boundary of the lower side wall;

a head assembly disposed between the upper cylindrical housing and the lower cylindrical housing, the head assembly further comprising:

a second circumferential recess defined within a topmost inside surface of the head assembly; and a second wiper ring disposed within the second circumferential recess, wherein the second wiper ring encircles a medial portion of the rod.

2. The cone rock crusher of claim 1, further comprising a piston assembly, wherein the rod is coupled to the piston assembly.

3. The cone rock crusher of claim 2, wherein:

the rod and piston assembly are received in and movable with respect to the lower cylindrical housing;

the rod passes through the upper bore of the upper cylindrical housing and the head assembly; and the rod is encircled by the first wiper ring and by the second wiper ring.

4. The cone rock crusher of claim 1, further comprising:

a first cylindrical flange coupled to an end of the upper cylindrical housing; and a second cylindrical flange coupled to an end of the lower cylindrical housing, wherein the second flange is configured to mate with the first cylindrical flange.

5. The cone rock crusher of claim 1, wherein:

the first wiper ring further comprises an inner portion, wherein the inner portion of the first wiper ring prevents contaminants from entering the clearing cylinder at the first circumferential recess; and the second wiper ring further comprises an inner portion, wherein the inner portion of the second wiper ring prevents contaminants from entering the clearing cylinder at the second circumferential recess.

6. The cone rock crusher of claim 1, wherein the second wiper ring comprises a U-shaped structure.

* * * * *